US006425384B1

(12) United States Patent
Howarth et al.

(10) Patent No.: US 6,425,384 B1
(45) Date of Patent: Jul. 30, 2002

(54) FUEL INJECTION DIAGNOSTIC CONTROL DEVICE

(75) Inventors: Mark Vincent Howarth, Lancs; Edward Christopher Zyla, Manchester, both of (GB)

(73) Assignee: Factor 1 Limited (GB)

( * ) Notice: Subject to any disclaimer, the term of this patent is extended or adjusted under 35 U.S.C. 154(b) by 0 days.

(21) Appl. No.: 09/486,572

(22) PCT Filed: Aug. 24, 1998

(86) PCT No.: PCT/GB98/02471

§ 371 (c)(1),
(2), (4) Date: May 24, 2000

(87) PCT Pub. No.: WO99/10751

PCT Pub. Date: Mar. 4, 1999

(30) Foreign Application Priority Data

Aug. 27, 1997 (GB) ..... 99717993

(51) Int. Cl.[7] ..... F02D 41/14; F02D 41/22
(52) U.S. Cl. ..... 123/690; 123/479
(58) Field of Search ..... 123/688, 690, 123/479; 701/107

(56) References Cited

U.S. PATENT DOCUMENTS 4,584,645 A * 4/1986 Kosak ..... 123/479
4,718,389 A * 1/1988 Hönig et al. ..... 123/479
4,750,128 A * 6/1988 Honda et al. ..... 123/479
5,107,426 A 4/1992 McGinty et al. ..... 701/29
5,124,919 A 6/1992 Kastelle ..... 701/29
5,214,582 A 5/1993 Gray ..... 701/33

OTHER PUBLICATIONS

International Preliminary Examination Report completed on Nov. 30, 1999 in International Application No. PCT/GB98/02471.

* cited by examiner

*Primary Examiner*—Andrew M. Dolinar
(74) *Attorney, Agent, or Firm*—Williams, Morgan & Amerson, P.C.

(57) ABSTRACT

A diagnostic/control device for fuel injected internal combustion engines comprising a control system (14) connectable via leads (16) to the fuel injectors (10) after disconnection therefrom of an engine management computer (11), the latter being connected directly (at 18) to the control system (14). An oxygen sensor (13) is connected (at 17) to the control system (14) whereby the latter is connected between the engine management computer (11) and the fuel injectors (10) and can be operated in closed circuit or open circuit mode to control the injectors directly when required independently of the engine management computer (11).

20 Claims, 2 Drawing Sheets

FUEL INJECTION DIAGNOSTIC CONTROL DEVICE

Figure 1:
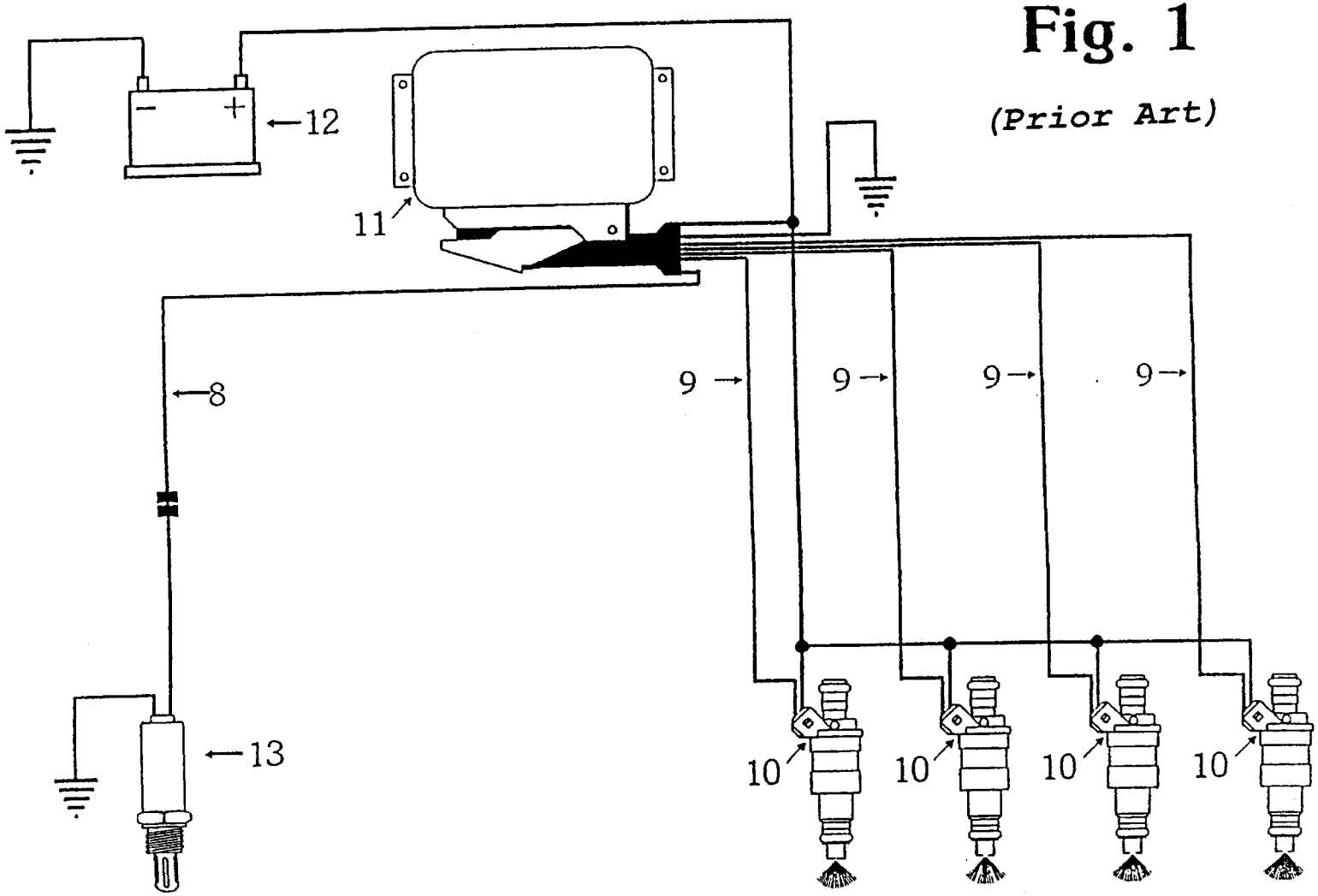
Fig. 1 (Prior Art)

THIS INVENTION relates to an automotive diagnostic aid or control device for petrol-driven, electronic fuel-injected (EFI) engines.

Most modern petrol driven production cars are fitted with catalytic converters and an engine management system which electronically controls the air/fuel ratio (AFR), incorporating the use of an oxygen sensor and operating in what is known as a "closed loop" mode. Oxygen readings are transmitted to an engine management computer (ECU) along with various other parameters, and adjustments are electronically made to provide repeated self-correction of the AFR. This is intended to cause the engine to run at perfect combustion with an AFR of 14.75:1 (also known as Factor 1).

This closed loop mode of operation can, however, render many faults difficult to diagnose. For example, a vehicle with an inlet manifold air leak would idle very erratically as the ECU attempts to compensate by adjusting the amount of fuel fed to the engine, based on incorrect readings taken from an air flow meter which is situated before the point of the air leak. This makes traditional diagnostic methods difficult as, in most case, it is necessary to make the engine stable before commencing common test procedures.

One approach to achieve stabilised running before curing a fault such as this is to take the vehicle out of closed loop mode and force it to run in an open loop condition by introducing a means for controlling the pulsing of the fuel injectors at a stabilised (non-fluctuating) rate. To achieve this by means of some kind of fuel controlling device and then to introduce a method of varying the pulses, the amount of fuel injected into the engine can be manually controlled. With the aid of an exhaust gas analyser many more tests can be performed such as catalytic converter testing when an engine is not running at Factor 1, by forcing it to do so and then monitoring the emissions from the exhaust.

Patent specification U.S. Pat. No. 5,214,582 describes an engine diagnostic/control system which is adapted to receive the sequential control signal from the ECU and reproduce it, without modification, while the engine is running. Alternatively, when the engine is not running, it may ignore the signal from the ECU while testing the injectors and other engine components for their operability. The device described in this document cannot operate in a open loop mode i.e. to take the control signal and to modify it thus to operate the injectors according to a modified signal.

Patent specification U.S. Pat. No. 5,107,426 is a further injection and ignition tester and is adapted for connection to an engine injector to test its operability. The device is connected in parallel to the ECU not between it and the injectors.

According to the present invention a diagnostic/control device for fuel injected internal combustion engines comprises a control system having means for electrical connection directly to at least one fuel injector of an engine and to an engine management computer, and further means to actuate said at least one injector independently of the engine management computer.

Further according to the present invention there is provided a method of testing fuel injected internal combustion engines comprising the steps of providing a control system, electrically connecting the control system directly to at least one fuel injector of an engine in place of an engine management computer normally connected thereto, connecting the control system also to the engine management computer, and causing the control system to actuate said at least one injector independently of the engine management computer.

Figure 2:
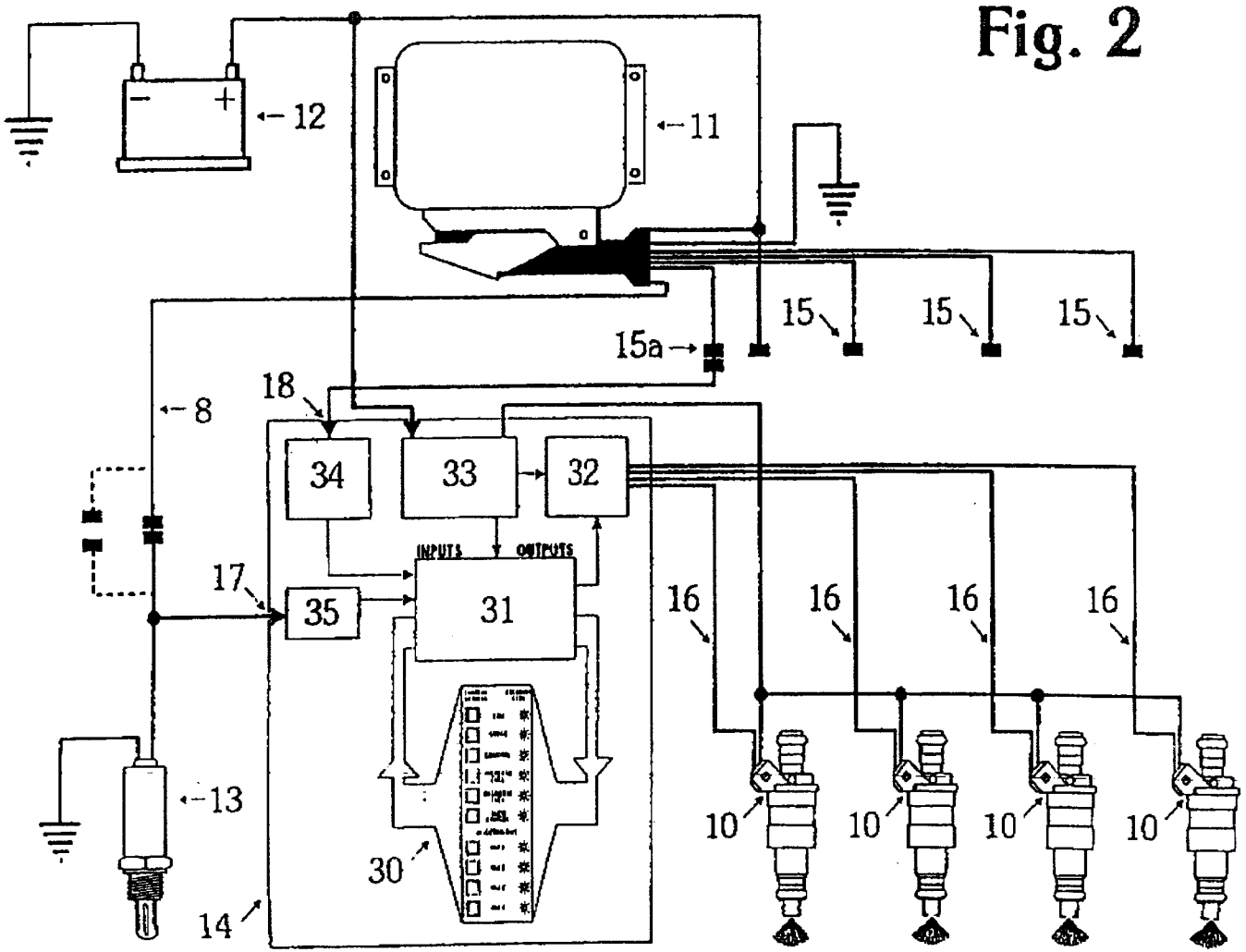

An embodiment of the invention will now be described, by way of example only, with reference to the accompanying drawings, in which:

FIG. 1 illustrates a conventional closed loop computer controlled fuel injection system;

FIG. 2 similarly illustrates a fuel injection system capable of operation in an open loop mode and including a control system connected in accordance with the invention.

Referring to FIG. 1 the fuel injectors of a four-cylinder internal combustion engine are illustrated at 10. Control, or pulsing, of the injectors is provided by an ECU 11 fed from the vehicle battery 12 and operating according to signals received from an oxygen sensor 13 which typically would be located in the exhaust system as close as possible to the engine and before any catalytic converter.

The ECU 11 is connected to the injectors 10 by leads 9 and to the oxygen sensor by a lead 8.

Referring now to FIG. 2, a control system provided in accordance with the invention is generally indicated at 14 and has been introduced "between" the ECU 11 and the injectors 10. Thus, the normal injector connection plugs 15 have been disconnected from the injectors 10 and have been replaced by four further leads 16 electrically connected to the control system 14. The oxygen sensor 13 is also connected at 17 to the control system. It will also be seen that one of the disconnected injector plugs 15*a* is connected at 18 to the control system 14 whereby the latter is connected also to the ECU 11.

As a result of these connections the control system 14 is directly and operably connected to the fuel injectors 10 and can control their operation independently of the ECU 11. However, the ECU must be connected to the control system to provide a reference signal for programme timings.

When the engine is started it will, by default, run in a "straight through" mode allowing the ECU 11 to have full control maintaining closed loop operation. However, it is possible now to store an injector pulse reading from the ECU 11 and continuously to reproduce it and manually modify it giving full control of fuel adjustment in an open loop mode of operation.

In this mode, the operation of the oxygen sensor 13 may be checked by the provision of two of the indicator lights on the control system showing the sensor's response to rich or lean running conditions.

From this mode it is possible to initiate an automatic mode of operation whereby the control system will continuously adjust the amount of fuel injected into the engine in response to the readings taken from the oxygen sensor much in the same way as does normally the ECU 11. However, unlike the ECU the control system 14 does not have connection to an array of sensors which give conflicting information during fault conditions.

The principal units within the control system 14, in addition to control buttons 3 and indicator lights 4 on a console 30, are a microprocessor 31, injector drivers 32, a voltage regulation suppression and protection device 33, and ECU injector input interface 34 and an oxygen sensor interface 35. The control system 14 cannot feed any signals back to the ECU therefore eliminating the possibility of damage thereto.

A number of diagnostic tests can be carried out with the system in view of the open loop mode in which it is capable of operation. For example, the catalytic converter may be tested by controlling the fuel supply to the injectors such that the correct AFR can be achieved and maintained, and thus the carbon monoxide or other emission content from the catalytic convertor may be checked using a gas analyser.

The oxygen sensor 13 itself may be checked as indicated previously by deliberately driving the engine rich and lean and checking whether the correct signals are received from the sensor.

Furthermore, it the system is used to ensure that the engine is running at Factor 1 i.e. an AFR of 14.75:1 and the engine is capable of achieving this independently of the ECU, this may confirm that the ECU is faulty if other possible faults have been eliminated.

Inlet manifold air leaks may be detected where resultant low vacuum leads to under fuelling and rough running of the engine. The control system may be used to increase the injector opening time to determine whether the engine will then run correctly thus helping to diagnose that an air leak is present. Similarly, the fuel fed to an individual cylinder may be increased to help diagnose an air leak while leaving the ECU 11 to control the remaining cylinders.

The control system may be used to operate the injectors in a pulsed mode when they are placed in a cleaning bath.

Preferably, the system will be supplied with adaptors enabling it to be use on engines having more than four cylinders.

The system is simple to operate given a set of instruction for an operator to carry out various tests, the results of such tests being readily available and/or computable from test results. The device may be extremely compact and sufficiently light weight to be hand-held with wiring looms of sufficient length that an operator may sit in the driving seat of the vehicle to conduct the tests.

In an alternative embodiment, a system in accordance with the invention may be permanently installed in a vehicle and, with signals received from appropriate sensors, can determine automatically when to take control of the injectors and when to return such control to the ECU. Thus, for example, the device may control the fuel injection according to predetermined parameters such as when the engine is at cruise with fuel conditions stabilised and the vehicle at a steady speed. Such operation is controlled entirely by the microprocessor with no need for control switches or indicator lights. Thus the device would not operate diagnostically, but as a device to control and optimise fuel economy and exhaust emissions.

The cable harnesses can be connected directly into the vehicle wiring, and the oxygen sensor will be fitted to the exhaust. Thus such an installation can be used effectively to upgrade older fuel injected vehicles to a closed loop system for exhaust gas monitoring to achieve more economical running with lesser hazardous emissions.

What is claimed is:

1. A diagnostic/control device for a fuel injected internal combustion engine, the device comprising a control system including means for electrical connection directly to at least one fuel injector of the engine and to an engine management computer normally connected thereto, the control system further including means for receiving a reference signal directly from the engine management computer and to modify the signal and, after modification of the signal, transmit the modified signal to said at least one fuel injector.

2. A device according to claim 1, having means for actuating said at least one injector according to the modified signal.

3. A device according to claim 1 or claim 2, wherein the control system is adapted to be connected between the engine management computer and said at least one fuel injector by disconnecting an engine injector connection plug and replacing same by a lead electrically connecting the control system directly to said at least one fuel injector.

4. A device according to claim 3, wherein means are provided for connecting a disconnected injector plug to the control system whereby the control system is connected to the engine management computer to provide a reference signal for programme timings.

5. A device according to claim 3, including means for connection to the control system of an oxygen sensor mounted in the engine exhaust system.

6. A device according to claim 3, wherein the control system includes a micro-processor.

7. A device according to claim 3, wherein the control system includes a console having an array of control switches and indicator lights for operator diagnostic use.

8. A device according to claim 3, including adaptor means enabling the control system to be connected to all injectors of engines having a variety of numbers of cylinders.

9. A device according to claim 3, being sufficiently compact to be hand-held and with wiring looms/connectors of sufficient length to enable an operator to sit in the driving seat of a vehicle to conduct tests on the engine.

10. A device according to claim 3, being adapted for permanent installation within a vehicle and adapted to control operation of the engine automatically according to predetermined parameters.

11. A device according to any one of claims 1 to 2, including means for connection to the control system of an oxygen sensor mounted in the engine exhaust system.

12. A device according to any one of claim 1 to 2, wherein the control system includes a micro-processor.

13. A device according to claim 6, wherein the microprocessor is connectable to the engine management computer such that signals cannot be fed back to the computer thus to prevent damage thereto.

14. A device according to any one of claims 1 to 2, wherein the control system includes a console having an array of control switches and indicator lights for operator diagnostic use.

15. A device according to any one of claims 1 to 2, including adaptor means enabling the control system to be connected to all injectors of engines having a variety of numbers of cylinders.

16. A device according to any one of claims 1 to 2, being sufficiently compact to be hand-held and with wiring looms/connectors of sufficient length to enable an operator to sit in the driving seat of a vehicle to conduct tests on the engine.

17. A device according to any one of claims 1 to 2, being adapted for permanent installation within a vehicle and adapted to control operation of the engine automatically according to predetermined parameters.

18. A method of testing a fuel injected internal combustion engine having an engine management computer, comprising the steps of providing a device including a control system, electrically connecting the control system directly to at least one fuel injector of an engine in place of an engine management computer normally connected thereto, connecting the control system also to the engine management computer, and modifying a signal therefrom to cause the control system to actuate said at least one injector according to the modified signal.

19. A method according to claim 18, wherein the control system is electrically and operably connected between all of the fuel injectors of an engine, and an engine management computer, storing an injector pulse reading from the engine management computer and continuously reproducing said reading and modifying same to give control of fuel adjustment in an open loop mode of operation.

20. A method according to claim 18 or claim 19, including, in an automatic mode of operation, the step of continuously adjusting the amount of fuel injected into the engine in response to readings taken from an oxygen sensor thus to achieve a predetermined air to fuel ratio.

* * * * *